US009528297B2

(12) United States Patent
Gentile

(10) Patent No.: US 9,528,297 B2
(45) Date of Patent: Dec. 27, 2016

(54) MAGNETIC LOCK AND KEY ASSEMBLY

(71) Applicant: Rexnord Industries, LLC, Milwaukee, WI (US)

(72) Inventor: Frank L. Gentile, Seymour, CT (US)

(73) Assignee: Rexnord Industries, LLC, Milwaukee, WI (US)

( * ) Notice: Subject to any disclaimer, the term of this patent is extended or adjusted under 35 U.S.C. 154(b) by 0 days.

(21) Appl. No.: 14/672,360

(22) Filed: Mar. 30, 2015

(65) Prior Publication Data

US 2016/0290011 A1 Oct. 6, 2016

(51) Int. Cl.
*E05B 47/00* (2006.01)
*E05B 67/36* (2006.01)

(52) U.S. Cl.
CPC ..... *E05B 47/0045* (2013.01); *E05B 47/0038* (2013.01); *E05B 67/365* (2013.01)

(58) Field of Classification Search
CPC E05B 47/0038; E05B 47/004; E05B 47/0042; E05B 47/0044; E05B 47/0045; E05B 65/00; E05B 69/00; E05B 69/03; E05B 73/00; E05B 73/0017; E05B 73/0023; E05B 73/0047; E05B 73/0052; E05B 73/0058; E05B 67/36; E05B 67/365
See application file for complete search history.

(56) References Cited

U.S. PATENT DOCUMENTS 1,154,078 A 9/1915 Upton
1,434,110 A 10/1922 Freysinger
2,049,742 A 8/1936 Lowe
2,121,301 A 6/1938 Ractliffe
2,177,996 A 10/1939 Raymond
3,234,767 A 2/1966 Allander
3,421,348 A 1/1969 Hallmann
3,602,020 A 8/1971 Kajita
3,633,393 A 1/1972 Hisatsune
3,656,328 A 4/1972 Hughes
(Continued)

FOREIGN PATENT DOCUMENTS

DE 102008006135 A1 7/2009

OTHER PUBLICATIONS

Highfield Mfg. Co. Drawing of Beta Lock With Seal, Aug. 11, 1997.
(Continued)

*Primary Examiner* — Christopher Boswell
(74) *Attorney, Agent, or Firm* — Quarles & Brady LLP

(57) ABSTRACT

A magnetic lock and key system including a magnetic lock that includes: a body, a lock element arranged at least partially within the body and moveable between a locked position and an unlocked position, a cap coupled to the body and defining a dome, and an arc magnet arranged within the body between the cap and the lock element, the arc magnet defining a chamfered edge and moveable between a first position corresponding with the locked position of the lock element and a second position corresponding to the unlocked position of the lock element; and a magnetic key arranged to engage the cap of the magnetic lock and including a key magnet moveable between a first position spaced apart from the dome of the cap, and a second position adjacent the dome of the cap, the key magnet defining a countersink corresponding to chamfered edge.

20 Claims, 9 Drawing Sheets

(56) References Cited

U.S. PATENT DOCUMENTS

| | | | | | |
|---|---|---|---|---|---|
| 3,757,551 | A | | 9/1973 | Willach | |
| 3,782,147 | A | | 1/1974 | Hallmann | |
| 3,797,288 | A | | 3/1974 | Hallmann | |
| 3,858,280 | A | | 1/1975 | Martens | |
| 3,965,710 | A | | 6/1976 | McCurdy | |
| 3,967,479 | A | | 7/1976 | Vick | |
| 4,096,718 | A | | 6/1978 | Michelman et al. | |
| 4,228,667 | A | | 10/1980 | Herriott | |
| 4,287,733 | A | | 9/1981 | Gomez-Olea | |
| 4,294,091 | A | | 10/1981 | Prunbauer | |
| 4,333,327 | A | | 6/1982 | Wake | |
| 4,380,162 | A | | 4/1983 | Woolfson | |
| 4,414,915 | A | | 11/1983 | Graybeal | |
| 4,440,007 | A | | 4/1984 | Prunbauer | |
| 4,476,701 | A | | 10/1984 | Herriott | |
| 4,527,310 | A | * | 7/1985 | Vandebult | E05B 73/0017 24/136 R |
| 4,631,939 | A | | 12/1986 | Herriott | |
| 4,815,304 | A | | 3/1989 | Kesselman | |
| 4,841,758 | A | | 6/1989 | Ramblier | |
| 5,069,047 | A | * | 12/1991 | Lynch | E05B 73/0017 70/276 |
| 5,611,223 | A | | 3/1997 | Spitzer | |
| 5,870,909 | A | | 2/1999 | Saunders, Jr. et al. | |
| 5,955,951 | A | * | 9/1999 | Wischerop | E05B 73/0017 340/10.42 |
| 6,023,951 | A | * | 2/2000 | Maurer | G06Q 20/20 335/306 |
| 6,386,006 | B1 | | 5/2002 | DeWalch | |
| 6,705,139 | B2 | | 3/2004 | Tsai | |
| 6,763,691 | B1 | | 7/2004 | Rafferty | |
| 7,125,058 | B2 | | 10/2006 | Hawthorne | |
| 7,267,378 | B2 | | 9/2007 | Drumm | |
| 7,391,327 | B2 | * | 6/2008 | Ho | E05B 73/0017 335/284 |
| 8,051,686 | B2 | * | 11/2011 | Garner | E05B 17/2015 340/572.1 |
| 8,083,274 | B2 | | 12/2011 | Caldwell et al. | |
| 8,863,563 | B2 | | 10/2014 | Gentile et al. | |
| 8,912,904 | B2 | * | 12/2014 | Ho | E05B 73/0017 24/704.1 |
| 8,978,427 | B2 | * | 3/2015 | Ho | E05B 73/0017 70/14 |
| 2007/0028429 | A1 | | 2/2007 | Ishida | |
| 2008/0066507 | A1 | | 3/2008 | Trempala et al. | |
| 2011/0209509 | A1 | | 9/2011 | Nickeas et al. | |
| 2012/0131967 | A1 | * | 5/2012 | Sanchez Giraldez | A41F 1/002 70/276 |
| 2012/0210757 | A1 | | 8/2012 | Gentile | |
| 2012/0291501 | A1 | * | 11/2012 | Gentile | E05B 47/0038 70/276 |

OTHER PUBLICATIONS

PCT International Search Report and Written Opinion, PCT/US2016/024750, Jun. 16, 2016.

* cited by examiner

MAGNETIC LOCK AND KEY ASSEMBLY

RELATED APPLICATIONS

Not applicable.

BACKGROUND

The invention relates generally to a magnetic lock and key assembly. More particularly, the invention relates to a magnetic lock assembly configured to operate in cooperation with a corresponding magnetic key assembly.

Many conventional locks include internal lock components that are mechanically engaged by a key inserted into an opening in the lock. This general lock configuration incorporates a number of precision elements that must work in concert to ensure proper operation of the lock. In addition, the opening in the lock hampers the operational life and ultimate security afforded by the lock. For instance, debris, such as dust, water, and other contaminants can enter the lock through the opening and foul the internal lock components. Furthermore, nefarious characters exploit the key opening in efforts to tamper with and defeat the security aspects of the lock.

Magnetic lock and key assemblies are generally described in U.S. application Ser. No. 13/561,785 filed on Jul. 30, 2012, U.S. application Ser. No. 13/400,428 filed on Feb. 20, 2012, and U.S. application Ser. No. 13/034,499 filed on Feb. 24, 2011. The entire disclosures of the above-listed applications are hereby incorporated by reference as if fully set forth herein.

In light of at least the above considerations, a need exists for a lock assembly having improved construction and operation.

BRIEF SUMMARY OF THE INVENTION

In one aspect, the present invention provides a magnetic lock and key system including a magnetic lock that includes: a body, a lock element arranged at least partially within the body and moveable between a locked position and an unlocked position, a cap coupled to the body and defining a dome, and an arc magnet arranged within the body between the cap and the lock element, the arc magnet defining a chamfered edge and moveable between a first position corresponding with the locked position of the lock element and a second position corresponding to the unlocked position of the lock element; and a magnetic key arranged to engage the cap of the magnetic lock and including a key magnet moveable between a first position spaced apart from the dome of the cap, and a second position adjacent the dome of the cap, the key magnet defining a countersink corresponding to the chamfered edge.

In another aspect, the invention provides a magnetic lock for use with a magnetic key, the magnetic lock including a body, a lock element arranged at least partially within the body and moveable between a locked position and an unlocked position, a cap coupled to the body and defining a dome, and an arc magnet arranged within the body between the cap and the lock element, the arc magnet defining a chamfered edge and moveable between a first position corresponding with the locked position of the lock element and a second position corresponding to the unlocked position of the lock element.

In another aspect, the invention provides a magnetic key for use with a magnetic lock, the magnetic key including a handle, a trigger coupled to the handle and rotatable relative thereto between a first position and a second position, a collet coupled to the handle, configured to engage the magnetic lock, and defining a magnet aperture, and a key magnet received in the magnet aperture and defining a countersink, the key magnet is free to rotate within the collet and is actuatable by the trigger between an on position and an off position.

The foregoing and other aspects and advantages of the invention will appear from the following description. In the description, reference is made to the accompanying drawings that form a part hereof, and in which there is shown by way of illustration a preferred embodiment of the invention. Such embodiment does not necessarily represent the full scope of the invention, however, and reference is made therefore to the claims and herein for interpreting the scope of the invention.

BRIEF DESCRIPTION OF DRAWINGS

The invention will be better understood and features, aspects, and advantages other than those set forth above will become apparent when consideration is given to the following detailed description thereof. Such detailed description makes reference to the following drawings.

DETAILED DESCRIPTION OF THE INVENTION

Figure 1:
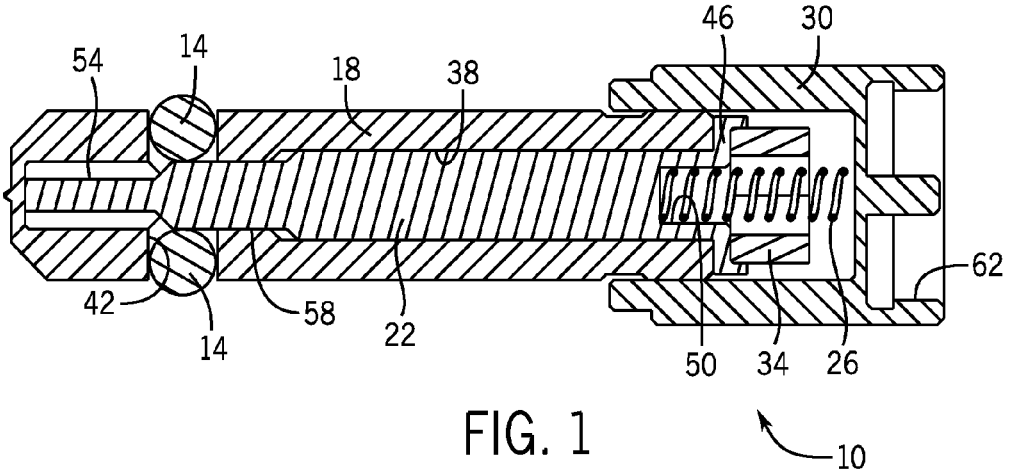
FIG. 1 is a sectional view of a magnetic lock.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 shows a magnetic lock 10 that includes a lock element in the form of two steel balls 14 received in a lock body 18, a plunger 22 received in the lock body 18, a compression spring 26, a keyed cap 30, and an arc magnet 34. The lock body 18 defines a plunger aperture 38 extending along a longitudinal axis of the lock body 18 and sized to receive the plunger 22, and locking apertures 42 formed in the lock body 18 transverse to the plunger aperture 38 and sized to receive the steel balls 14. In other embodiments, the locking element may be a lever, or a different locking mechanism, as desired. Additionally, any suitable material may be used for the locking element.

The plunger 22 defines a countersink 46 arranged to receive (e.g., rotatably, fixably, or otherwise) the arc magnet 34, a spring aperture 50 recessed into the countersink 46 and sized to receive the compression spring 26, an unlocking diameter 54, and a locking diameter 58.

The keyed cap 30 is rigidly coupled to the lock body 18 to capture the plunger 22, the compression spring 26, and the arc magnet 34 therebetween. The plunger 22 and/or the arc magnet 34 may be rotatable within the lock body 18. The keyed cap 30 defines a key receiving feature 62.

Figure 7:
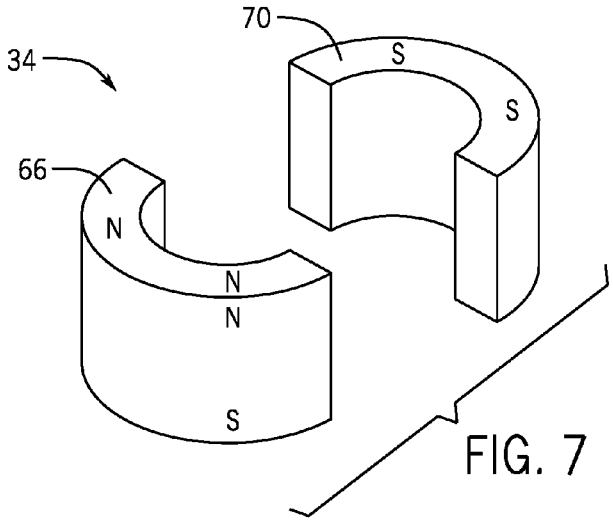
FIG. 7 is an exploded pictorial view of an arc magnet.

The arc magnet 34 will be described with respect to FIG. 7. The arc magnet 34 includes a first magnet half 66 and a second magnet half 70 coupled together. In one embodiment, the first half 66 is bonded to the second half 70 with adhesive. The first half 66 and the second half 70 are each axially magnetized permanent magnets and define a central aperture such that when the arc magnet 34 is assembled a central aperture sized to receive the compression spring 26 is formed. The first half 66 and the second half 70 are arranged so that the arc magnet 34 has a north pole on one of the first half 66 and the second half 70 (e.g., a top surface of the first half 66 as shown in FIG. 7) and a south pole on the other half (e.g., a top surface of the second half 70 as shown in FIG. 7).

Turning back to FIG. 1, the magnetic lock 10 is assembled by, in one example, bonding the arc magnet 34 into the countersink 46 of the plunger 22. The two steel balls 14 are installed in the locking apertures 42 of the lock body 18, and the plunger is inserted into the plunger aperture 38 of the lock body 18. The compression spring 26 is then placed in the spring aperture 50, and the keyed cap 30 is coupled to the lock body 18.

Figure 4:
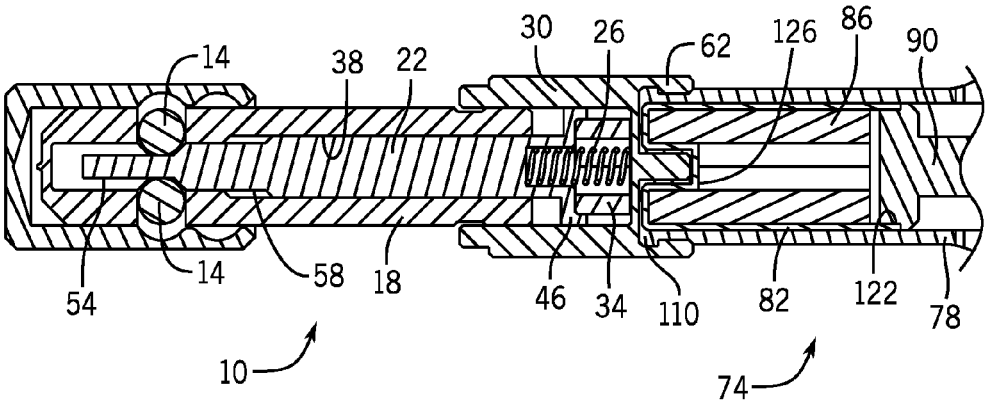
FIG. 4 is a sectional view of the magnetic lock of FIG. 1 and the magnetic key of FIG. 2 coupled together in a second position.

In operation, the magnetic lock 10 is movable between a first or locked position (shown in FIG. 1) and a second or unlocked position (see FIG. 4). The illustrated magnetic lock 10 is normally arranged in the locked position with the compression spring 26 biasing the plunger 22 toward and into a locked position with the steel balls 14 forced outward by the locking diameter 58 of the plunger 22. When a suitable magnetic field is enacted on the arc magnet 34, the magnetic attraction draws the arc magnet 34 toward an unlocked position against the bias of the compression spring 26. As shown in FIG. 4, when the arc magnet 34 is drawn to the unlocked position toward the keyed cap 30, the two balls 14 move inward with respect to the lock body 18 and into contact with the unlocking diameter 54 of the plunger 22.

Figure 2:
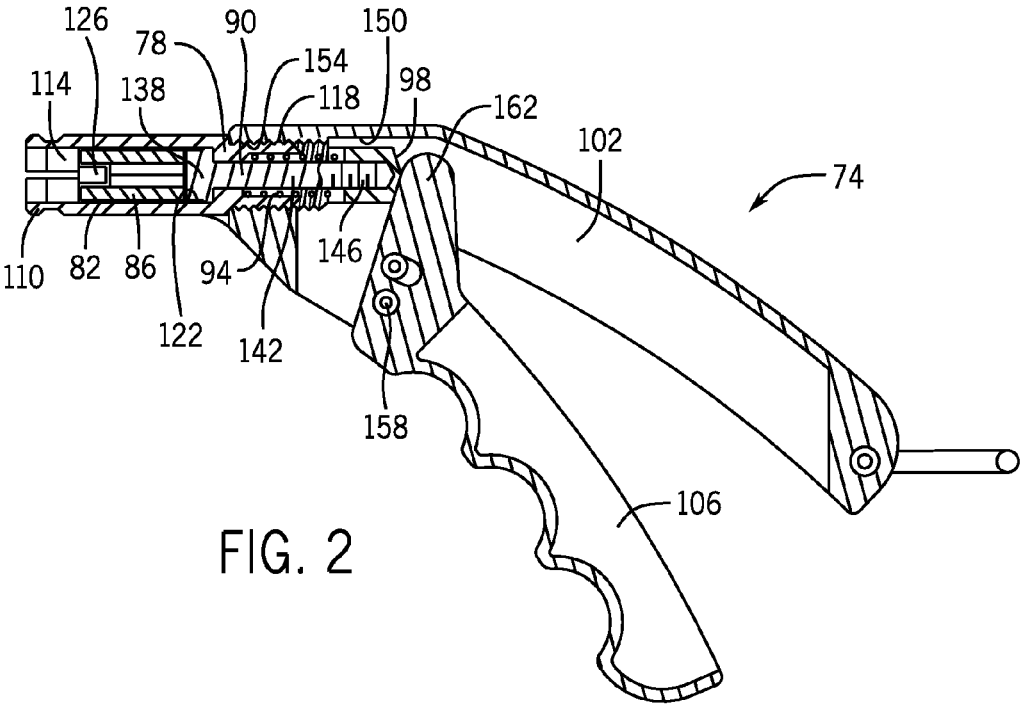
FIG. 2 is a sectional view of a magnetic key.

FIG. 2 shows a magnetic key 74 that includes a collet 78, a magnet cup 82, a key magnet 86, a pusher rod 90, a return spring 94, an end cap 98, a handle 102, and a trigger 106. The collet 78 includes fingers 110 arranged to engage the key receiving feature 62 of the magnetic lock 10. A magnet aperture 114 is defined in an end of the collet 78 adjacent the fingers 110 and is sized to receive the magnet cup 82. A coupling feature in the form of threads 118 couple the collet 78 to the handle 102.

The magnet cup 82 defines an open end 122 arranged to receive the key magnet 86 and a closed lock engaging end 126 that is produced with features corresponding to the features of the key receiving feature 62 of the magnetic lock 10. The magnet cup 82 is sized to be slidingly received in the magnet aperture 114 of the collet 78.

Figure 8:
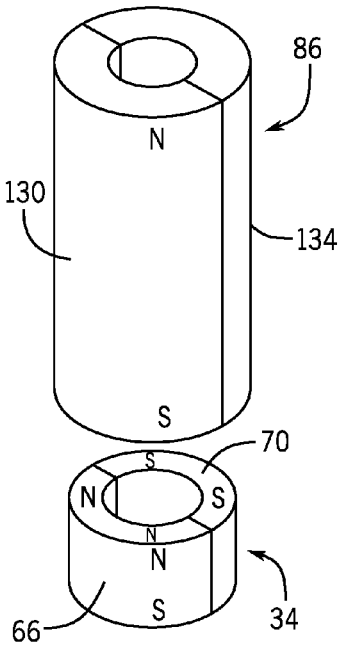
FIG. 8 is a pictorial view of the arc magnet of FIG. 7 and a key magnet.

The key magnet 86 will be described with respect to FIG. 8. The key magnet 86 includes a first magnet half 130 and a second magnet half 134 coupled together. In one embodiment, the first half 130 is bonded to the second half 134 with adhesive. The first half 130 and the second half 134 are each axially magnetized permanent magnets and define a central aperture such that when the key magnet 86 is assembled a central aperture is formed. The first half 130 and the second half 134 are arranged so that the key magnet 86 has a north pole on one of the first half 130 and the second half 134 (e.g., a top surface of the first half 130 as shown in FIG. 8) and a south pole on the other half (e.g., a top surface of the second half 134 as shown in FIG. 8).

Turning back to FIG. 2, the pusher rod 90 includes a head 138 sized to be press fit into the open end 122 of the magnet cup 82, a shaft 142 extending from the head 138, and a coupling portion 146 located opposite the head 138 and arranged to engage the end cap 98.

The handle 102 defines a key mechanism aperture 150 and a collet engaging portion 154 arranged to engage the threads 118 of the collet 78. The trigger 106 includes a pivot point 158 and a lever 162.

The magnetic key 74 is assembled by inserting the key magnet 86 into the magnet cup 82, and then press fitting the head 138 of the pusher rod 90. The spring 94 is then installed over the shaft 142 of the pusher rod 90 as it extends through the collet 78, and the end cap 98 is coupled to the coupling portion 146 of the pusher rod 90. The collet 78 is then threadingly coupled to the handle 102 with the end cap 98, the spring 94, and a portion of the pusher rod 90 received within the key mechanism aperture 150. The trigger 106 is coupled to the handle 102 via the pivot point 158 with the lever 162 arranged to engage the end cap 98 as shown in FIG. 2.

In operation, the magnetic key 74 is actuatable between an off position (shown in FIG. 2) and an on position (generally shown in FIG. 3), via manipulation of the trigger 106. The return spring 94 biases the magnetic key 74 toward the off position by biasing the end cap 98 away from the collet 78. To force the magnetic key 74 toward the on position, the trigger 106 is pulled such that the lever 162 urges the end cap 98 toward the collet 78 against the bias of the return spring 94. In turn, the pusher rod 90 moves and forces the magnet cup 82 toward the fingers 110 of the collet 78. The key magnet 86 is trapped by the magnet cup 82 and is moved therewith. Upon releasing the trigger 106, the return spring 94 returns the magnetic key 74 to the off position. Additionally, the key magnet 86 is arranged and received within the magnet cup 82 such that the key magnet 86 can, in some embodiments, rotate freely.

Figure 3:
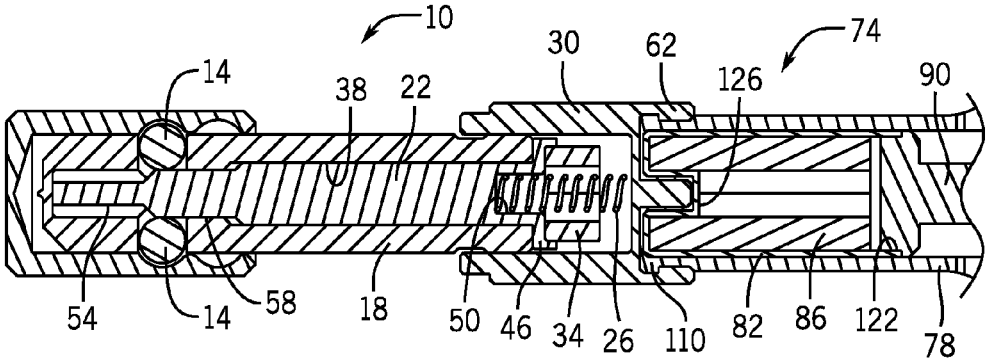
FIG. 3 is a sectional view of the magnetic lock of FIG. 1 and the magnetic key of FIG. 2 coupled together in a first position.

Coordinated operation of the magnetic lock 10 and the magnetic key 74 will be discussed below with respect to FIGS. 3-6. FIG. 3 shows the magnetic lock 10 arranged in the locked position, the magnetic key 74 engaged with the magnetic lock 10 such that the fingers 110 of the collet 78 are engaged with the key receiving feature 62 of the keyed cap 30, and the magnetic key 74 in the on position. The fingers 110 may be tapered radially inward or otherwise configured such that the fingers 110 flex radially outward due to interaction with the magnet cup 82 and/or the key magnet 86 when the magnetic key 74 is in the on position. FIG. 3 shows the initial condition when the magnetic key 74 is inserted into the magnetic lock 10 and the trigger 106 is pulled. As shown, the key magnet 86 is not necessarily initially magnetically aligned with the arc magnet 34. With the key magnet 86 in sufficiently close proximity to the arc magnet 34, the key magnet 86 rotates within the magnet cup 82 to align with the poles of the arc magnet 34. Alternatively, the arc magnet 34 may be rotatable alone or in addition to the key magnet 86.

Turning to FIG. 4, once the key magnet 86 and the arc magnet 34 are sufficiently aligned, the attractive force between the key magnet 86 and the arc magnet 34 will overcome the bias of the compression spring 26 and the plunger 22 will be pulled toward the keyed cap 30 and the magnetic lock 10 is moved to the unlocked position.

Figure 5:
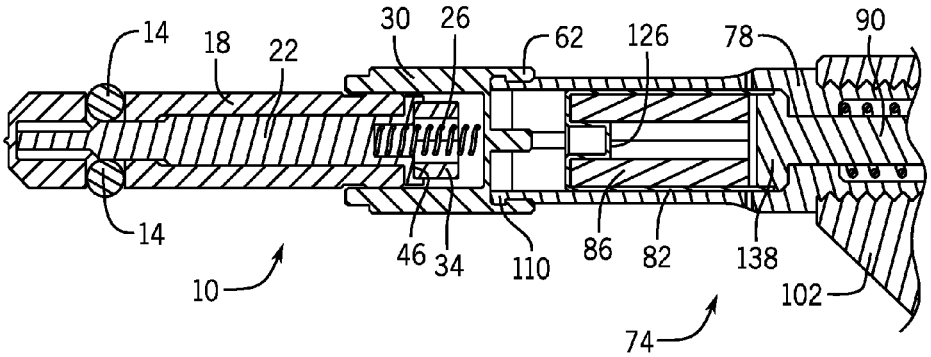
FIG. 5 is a sectional view of the magnetic lock of FIG. 1 and the magnetic key of FIG. 2 coupled together in a third position.

After the magnetic lock 10 is unlocked, the trigger 106 is released and the magnetic key 74 moves back to the off position (as shown in FIG. 5). With the key magnet 86 moved away from the arc magnet 34, the compression spring 26 forces the plunger 22 away from the keyed cap 30 and the magnetic lock 10 returns to the locked position.

Figure 6:
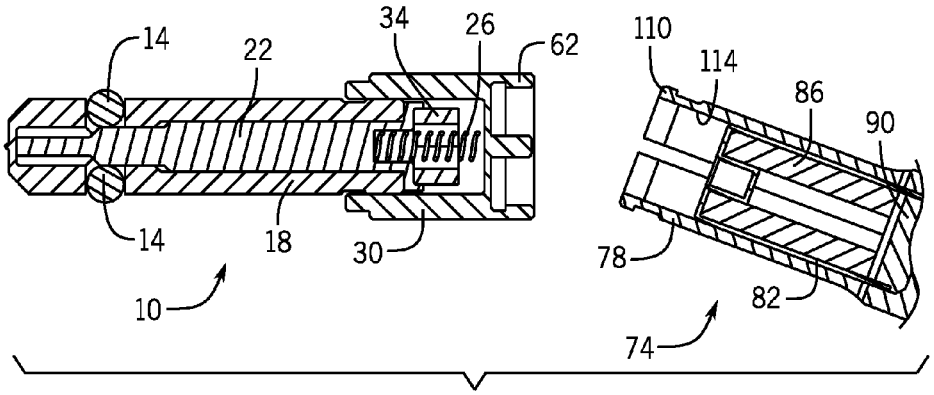
FIG. 6 is a sectional view of the magnetic lock of FIG. 1 and the magnetic key of FIG. 2 decoupled from one another.

FIG. 6 shows how the magnetic key 74 is removed from the magnetic lock 10 by pulling and rotating the magnetic key 74 relative to the magnetic lock 10 such that the fingers 110 flex and disengage from the key receiving feature 62 of the keyed cap 30.

Figure 9:
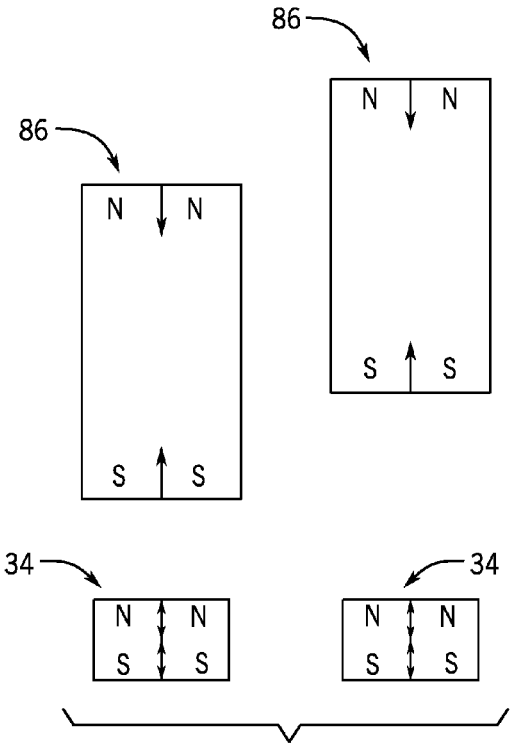
FIG. 9 is a plan view of the arc magnet of FIG. 7 and the key magnet of FIG. 8 arranged in two different positions.

A more detailed discussion of the interaction between the arc magnet 34 and the key magnet 86 will be discussed with respect to FIGS. 8 and 9. As discussed above, the key magnet 86 is free to rotate (and/or the arc magnet 34 may also be free to rotate in some embodiments). As shown in FIG. 8, the key magnet 86 will tend to rotate into magnetic alignment with the arc magnet 34 when the key magnet 86 is within sufficient proximity to the arc magnet 34. In other words, when the magnets 34, 86 are placed within proximity to one another, the magnetic fields exert a rotational force between the magnets 34, 86 that tends to align the magnets 34, 86 so that the north pole at the top of the arc magnet 34 aligns with the south pole at the bottom of the key magnet 86 and vice versa. As long as one or both magnets 34, 86 are allowed to rotate freely, the magnets 34, 86 will always assume this orientation because this is the lowest energy state for the system.

When the magnets 34, 86 are aligned as above there is an attractive force parallel to the center axis that acts to pull the magnets 34, 86 closer together. The magnitude of this force is generally inversely proportional to the square of the distance or air gap between the magnets 34, 86. Therefore, doubling the air gap will decrease the attractive force between the magnet assemblies by a factor of four. In other words, the arrangement shown at the left in FIG. 9 experiences an attractive force four times larger than the arrangement shown at the right.

Figure 10:
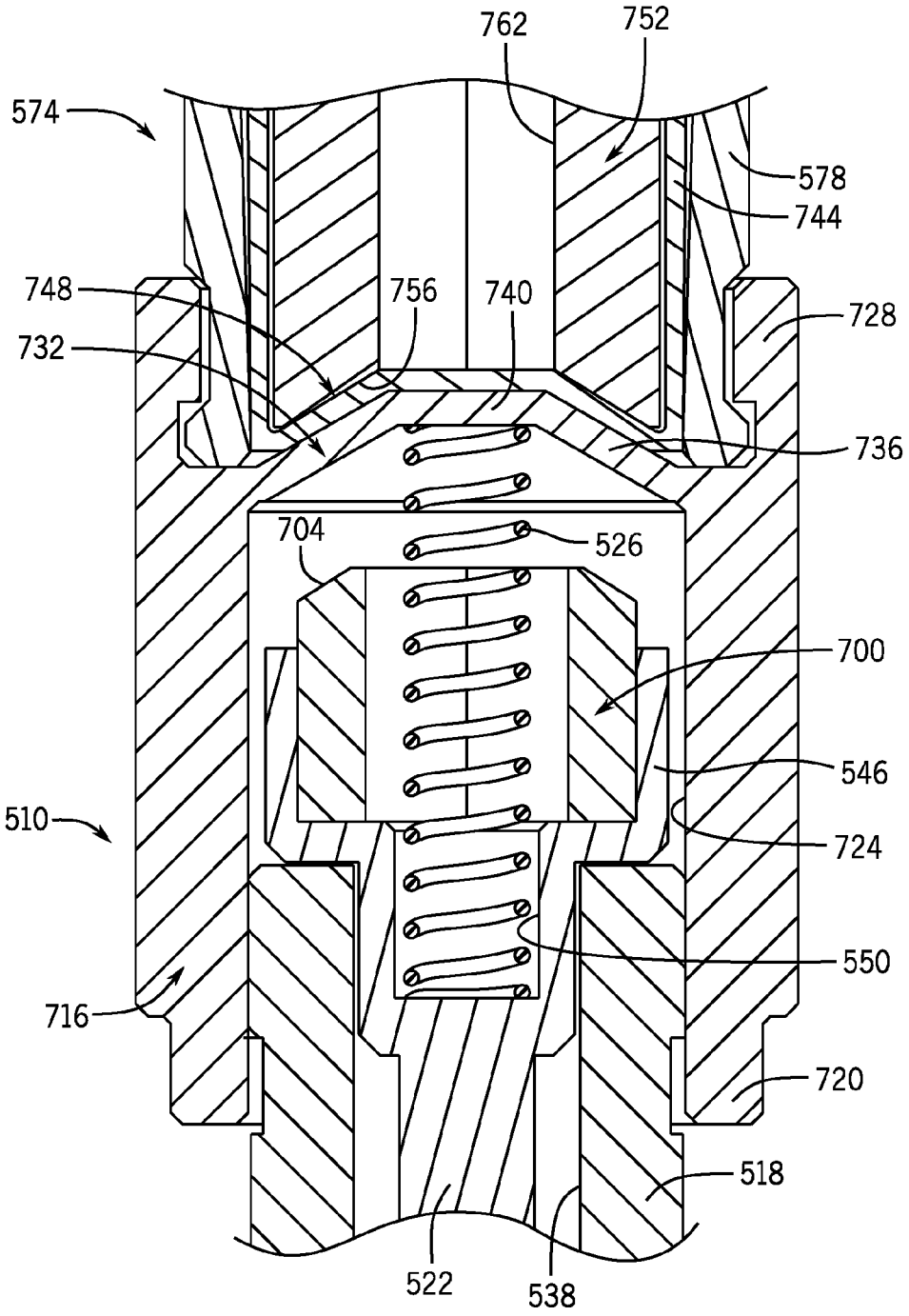
FIG. 10 is a sectional view of a magnetic key engaging a magnetic lock according to one embodiment of the invention.

Turning to FIG. 10, a new magnetic lock 510 and a new magnetic key 574 arrangement will be discussed. Many portions of the magnetic lock 510 and the magnetic key 574 are similar to the magnetic lock 10 and the magnetic key 74 discussed above and are numbered similarly in the 500 and 600 series accordingly.

Figure 15:
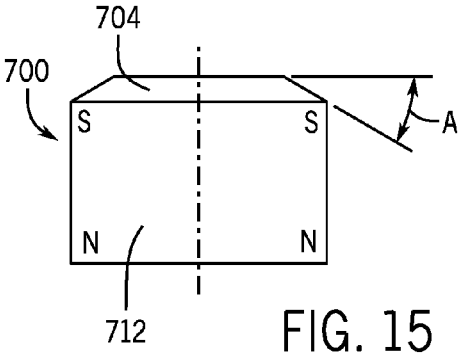
FIG. 15 is a plan view of the arc magnet of FIG. 14.

An arc magnet 700 is received in the countersink 546 of the plunger 522 similar to how the arc magnet 34 is received in the countersink 46 of the plunger 22 discussed with respect to FIG. 1. The arc magnet 700 defines a chamfered top edge 704 that is chamfered at an angle A of about thirty degrees (30°) with respect to horizontal (as shown in FIG. 15). The angle A may be different according to the desired characteristics of the magnetic lock 510. In other embodiments, the chamfered edge may be a curved surface, spherically shaped, arranged at different angles, or include another profile shape, as desired.

Figure 14:
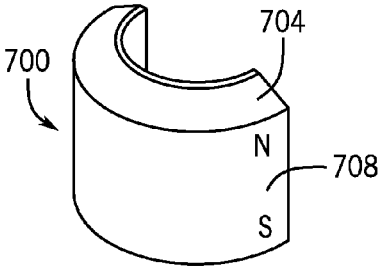
FIG. 14 is a pictorial view of an arc magnet according to one embodiment of the invention.

The arc magnet 700 includes a first magnet half 708 (see FIG. 14) and a second magnet half 712 (see FIG. 15) coupled together. In one embodiment, the first half 708 is bonded to the second half 712 with adhesive. The first half 708 and the second half 712 are each axially magnetized permanent magnets and define a central aperture such that when the arc magnet 700 is assembled a central aperture is formed. The first half 708 and the second half 712 are arranged so that the arc magnet 700 has a north pole on one of the first half 708 and the second half 712 (e.g., the chamfered surface 704 of the first half 708 as shown in FIG. 14) and a south pole on the other half (e.g., the chamfered surface 704 of the second half 712 as shown in FIG. 15).

A keyed cap 716 includes a body engaging portion 720 arranged to rigidly couple with the lock body 518, an interior cavity 724 sized to receive the plunger 522, the arc magnet 700, and the compression spring 526, an annular shoulder 728, and a dome 732. The dome 732 defines an annular and angled side wall 736 arranged at about the same angle as the angle A of the chamfered surface 704 on the arc magnet 700. In the illustrated embodiment, the angled side wall 736 is arranged at about thirty degrees (30°) with respect to horizontal (as shown in FIG. 10). A flat top surface 740 is defined at the top of the angled side wall 736.

The magnetic key 574 includes a magnet cup 744 that defines a closed lock engaging end 748 shaped to correspond to the shape and profile of the dome 732. That is to say, the closed lock engaging end 748 defines an inverted dome shape that is arranged to substantially mate with or receive the dome 732 of the keyed cap 716.

Figure 11:
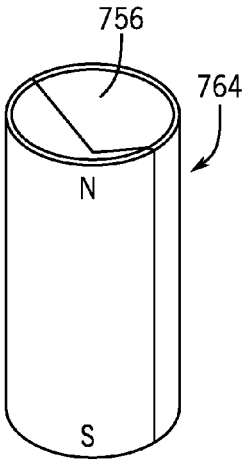
FIG. 11 is a pictorial view of a key magnet according to one embodiment of the invention.
Figure 12:
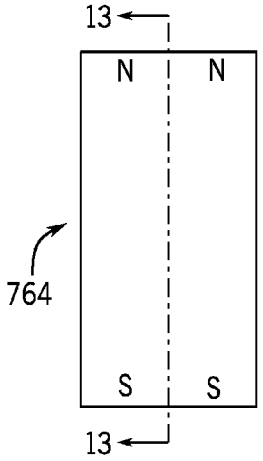
FIG. 12 is a plan view of the key magnet of FIG. 11.
Figure 13:
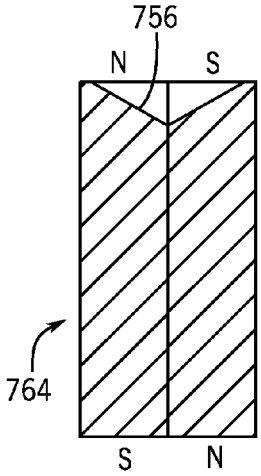
FIG. 13 is a sectional plan view of the key magnet of FIG. 11 taken along line 13-13 of FIG. 12.
Figure 16:
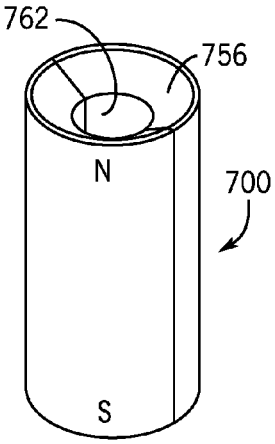
FIG. 16 is a pictorial view of a key magnet according to one embodiment of the invention.
Figure 17:
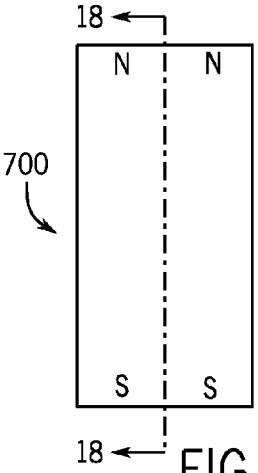
FIG. 17 is a plan view of the key magnet of FIG. 16.
Figure 18:
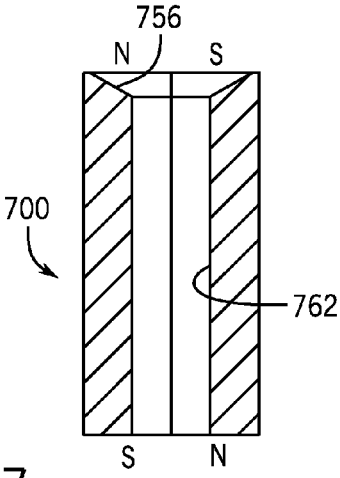
FIG. 18 is a sectional plan view of the key magnet of FIG. 16 taken along line 18-18 of FIG. 17.

A key magnet 752 is received within the magnet cup 744 and shaped to match the profile of the dome 732. In other words, the key magnet 752 defines a countersunk angled wall 756 shaped or angled to match the chamfered top edge 704 of the arc magnet 700. That is to say that in the illustrated embodiment, the angle of the countersink 756 is about thirty degrees (30°), but may be a different angle or a different shape, as desired. The key magnet 752 includes a central aperture 762 that extends along a longitudinal axis of the key magnet 752 (see FIGS. 16-18). FIGS. 11-13 show an alternative key magnet 764 that does not include a central aperture.

Figure 19:
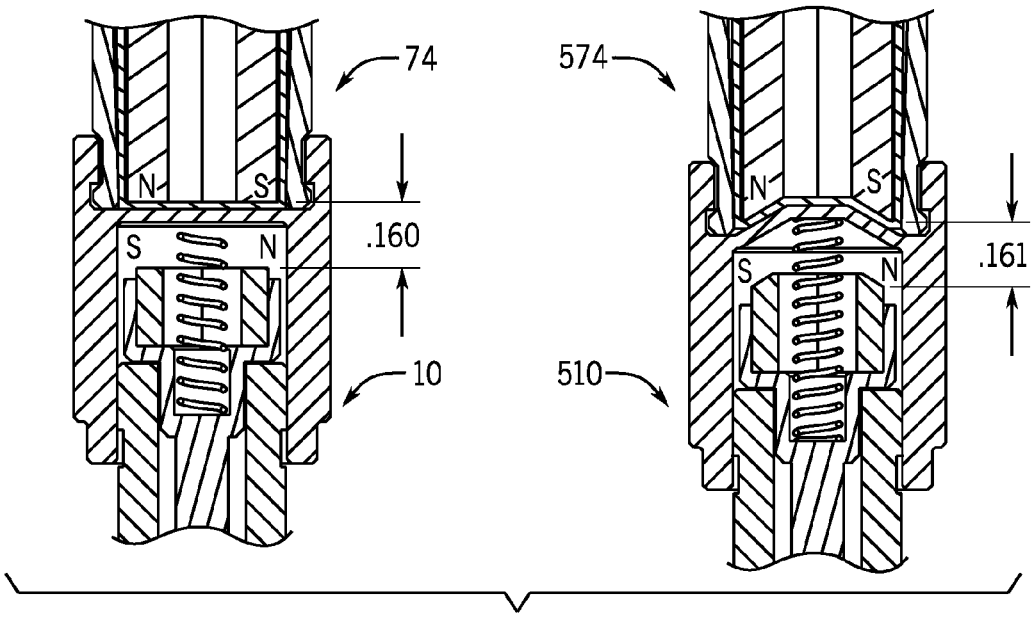
FIG. 19 is a sectional view of a magnetic lock similar to FIG. 1 and a magnetic key similar to FIG. 2 compared to the magnetic lock and magnetic key of FIG. 10.

FIG. 19 shows a comparison of the general magnetic lock 10 (without a central protrusion extending from the keyed cap 30) and the general magnetic key 74 (without a mating recess in the magnet cup 82) to the magnetic lock 510 and the magnetic key 574. As is shown, the effective gap between the magnets remains significantly consistent between the two designs. This allows both designs to function effectively using the principals outlined above. In the illustrated embodiment, the air gap is about 0.160 inches. In other embodiments, the size of the locks and the air gaps may be different, as desired.

Figure 20:
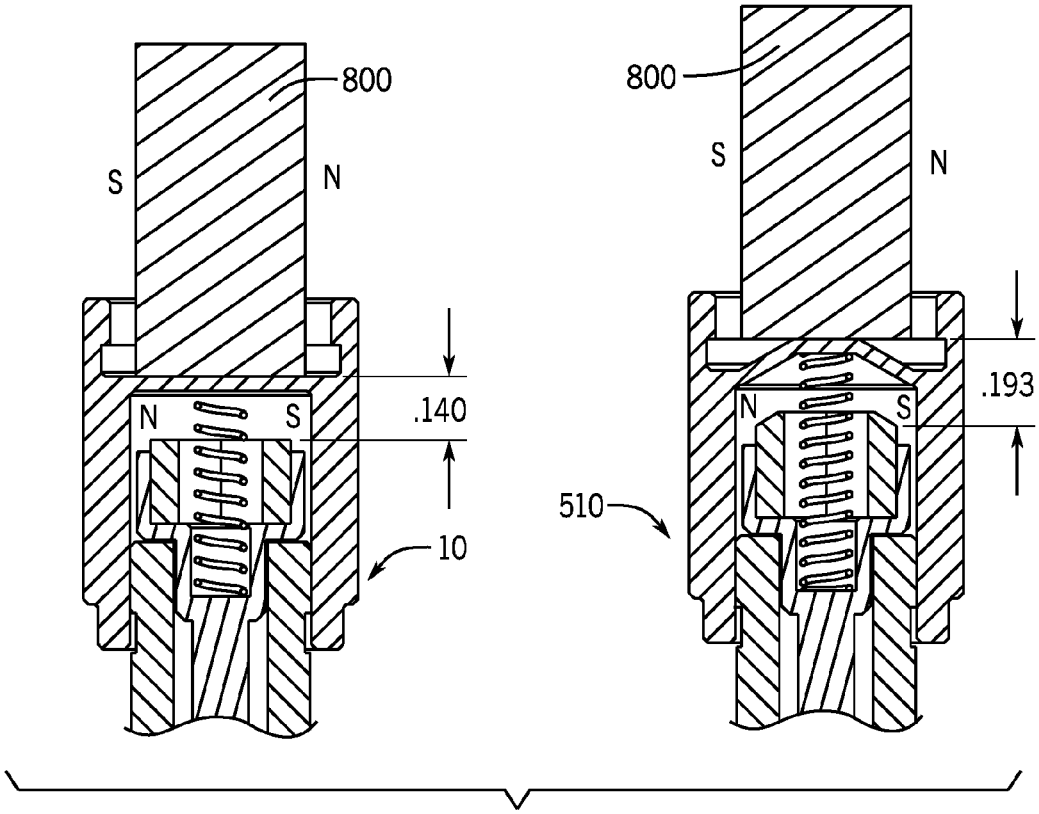
FIG. 20 is a sectional view of a magnetic lock similar to FIG. 1 compared to the magnetic lock of FIG. 10, each receiving a generic magnet.

FIG. 20 shows a similar comparison of the general magnetic lock 10 and the magnetic lock 510 when a non-key magnet 800 is inserted into the magnetic locks 10, 510. The magnetic lock 10 allows the non-key magnet 800 to achieve a proximity to the arc magnet 34 that is sufficient to actuate the magnetic lock 10 to the unlocked position. The dome 732 of the magnetic lock 510 inhibits the non-key magnet 800 from achieving a sufficient proximity. In other words, the non-key lock 800 cannot achieve a large enough attractive force with the arc magnet 700 to actuate the magnetic lock 510 to the unlocked position.

Figure 21:
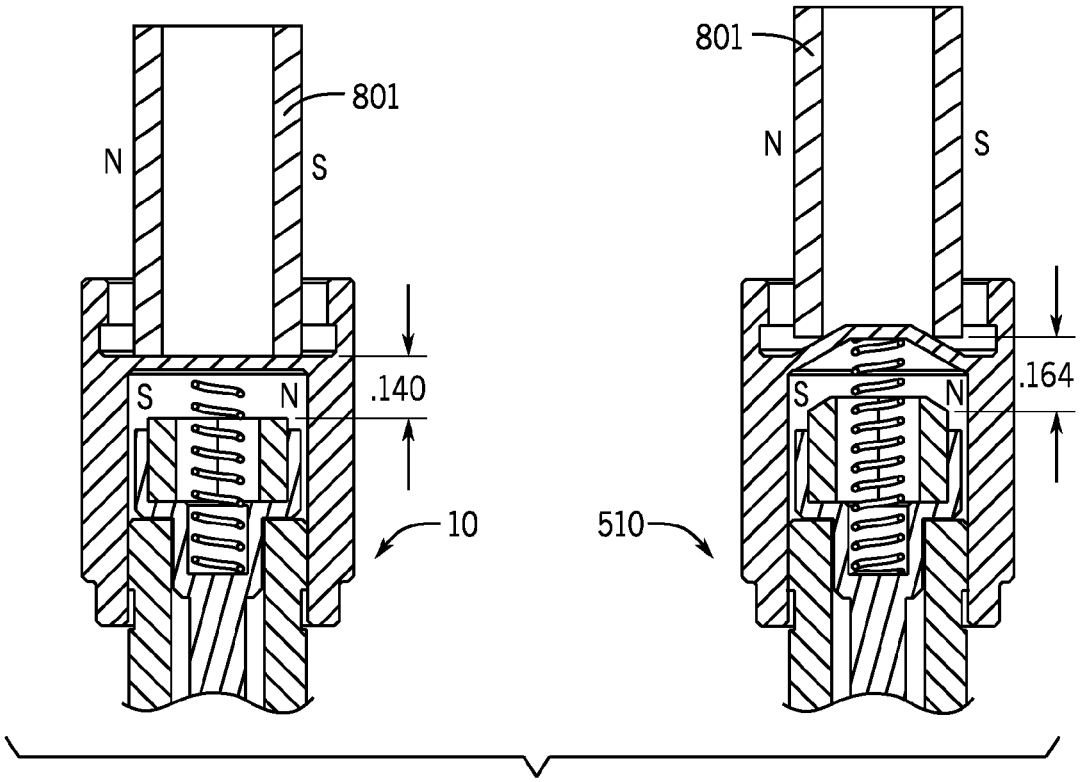
FIG. 21 is a sectional view of a magnetic lock similar to FIG. 1 compared to the magnetic lock of FIG. 10, each receiving another generic magnet.
Figure 22:
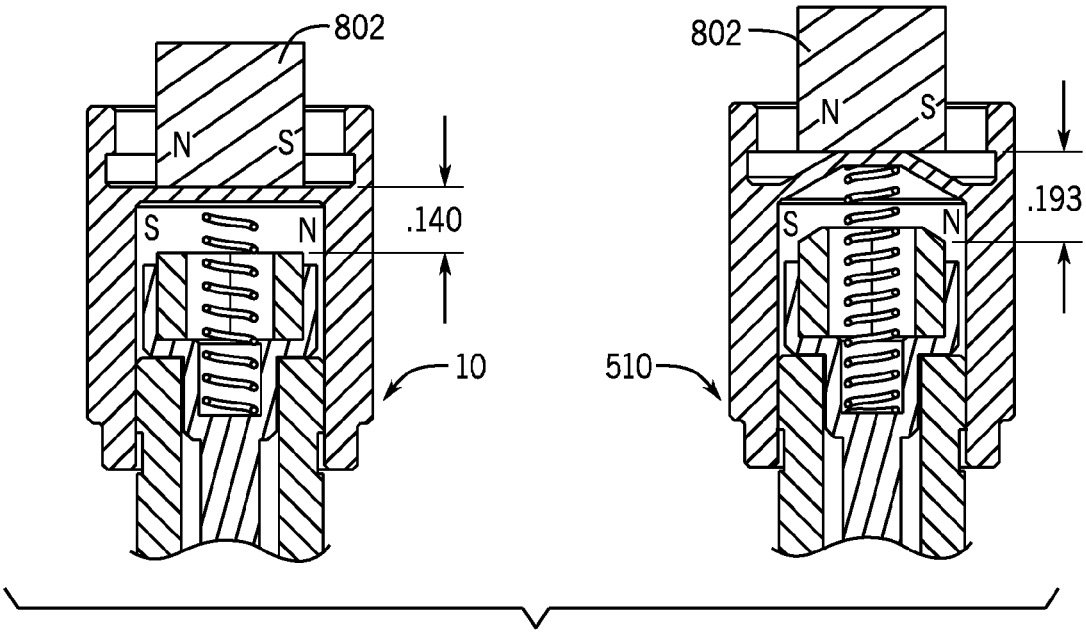
FIG. 22 is a sectional view of a magnetic lock similar to FIG. 1 compared to the magnetic lock of FIG. 10, each receiving a further generic magnet.
Figure 23:
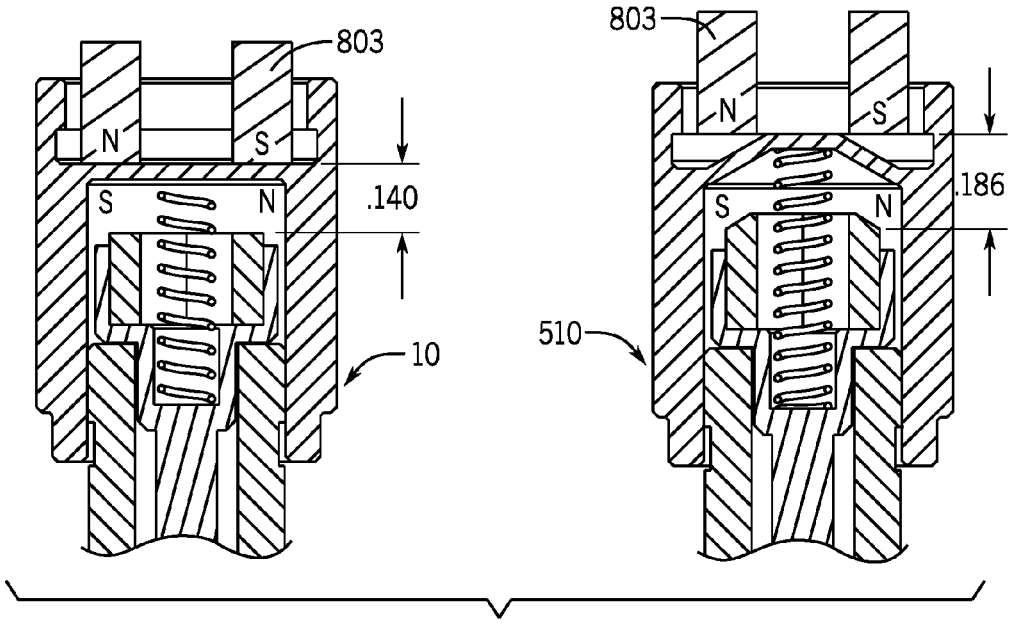
FIG. 23 is a sectional view of a magnetic lock similar to FIG. 1 compared to the magnetic lock of FIG. 10, each receiving yet another generic magnet.

Similarly, FIGS. 21-23 show examples of non-key magnets 801, 802, 803 engaged with the general magnetic lock 10 and the magnetic lock 510. In each scenario, the dome 732 is effective in increasing the proximity achieved by the non-key magnet 801, 802, 803 to the arc magnet 700. As discussed above, the attractive force is generally affected by the square of the distance between the magnets. In turn, the dome 732 is effective for greatly reducing the ability of non-key magnets to actuate the magnetic lock 510.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

I claim:

1. A magnetic lock and key system comprising:
a magnetic lock that includes
a body,
a lock element arranged at least partially within the body and moveable between a locked position and an unlocked position,
a cap coupled to the body and defining a dome, and
an arc magnet arranged within the body between the cap and the lock element, the arc magnet defining a chamfered edge and moveable between a first position corresponding with the locked position of the lock element and a second position corresponding to the unlocked position of the lock element; and
a magnetic key arranged to engage the cap of the magnetic lock and including a key magnet moveable between a first position spaced apart from the dome of the cap, and a second position adjacent the dome of the cap, the key magnet defining a countersink corresponding to the chamfered edge.

2. The magnetic lock and key system of claim 1, wherein the chamfered edge defines a profile, the countersink matching the profile.

3. The magnetic lock and key system of claim 2, wherein the profile defines an angle of about thirty degrees.

4. The magnetic lock and key system of claim 1, wherein the dome corresponds to the chamfered edge.

5. The magnetic lock and key system of claim 1, wherein the key magnet is free to rotate.

6. The magnetic lock and key system of claim 1, wherein the magnetic lock further includes a spring arranged to bias the arc magnet toward the first position.

7. The magnetic lock and key system of claim 6, wherein an attractive force is created between the key magnet and the arc magnet when the key magnet is in the second position, the attractive force overcoming the bias applied by the spring.

8. The magnetic lock and key system of claim 1, wherein the dome inhibits non-key magnets from actuating the magnetic lock.

9. The magnetic lock and key system of claim 1, wherein an air gap is defined between a top surface of the dome and the arc magnet, the air gap substantially inhibiting a non-key magnet from actuating the magnetic lock.

10. A magnetic lock for use with a magnetic key, the magnetic lock comprising:
a body;
a lock element arranged at least partially within the body and moveable between a locked position and an unlocked position;
a cap coupled to the body and defining a dome; and
an arc magnet arranged within the body between the cap and the lock element, the arc magnet defining a chamfered edge and moveable between a first position corresponding with the locked position of the lock element and a second position corresponding to the unlocked position of the lock element.

11. The magnetic lock of claim 10, further comprising a plunger arranged within the body, the arc magnet coupled to the plunger and moveable therewith to actuate the lock element.

12. The magnetic lock of claim 10, wherein the cap is rigidly coupled to the body.

13. The magnetic lock of claim 10, wherein the cap defines a shoulder configured to engage the magnetic key.

14. The magnetic lock of claim 10, wherein the dome defines an angled side wall and a substantially flat top surface.

15. The magnetic lock of claim 14, wherein the angled side wall is shaped to correspond to the chamfered edge.

16. The magnetic lock of claim 10, wherein the arc magnet includes a first half defining a north pole at the chamfered edge and a second half defining a south pole at the chamfered edge.

17. The magnetic lock of claim 10, wherein the chamfered edge defines about a thirty degree angle.

18. A magnetic key for use with a magnetic lock, the magnetic key comprising:

a handle;

a trigger coupled to the handle and rotatable relative thereto between a first position and a second position;

a collet coupled to the handle, configured to engage the magnetic lock, and defining a magnet aperture; and a key magnet received in the magnet aperture and defining a chamfered countersink, the key magnet is free to rotate within the collet and is actuatable by the trigger between an on position and an off position.

19. The magnetic key of claim 18, wherein the countersink is substantially conically shaped and defines an angle of about thirty degrees.

20. The magnetic key of claim 18, wherein the key magnet defines a central aperture.

* * * * *